US006257477B1

(12) United States Patent
Strååt et al.

(10) Patent No.: US 6,257,477 B1
(45) Date of Patent: Jul. 10, 2001

(54) STAPLER WITH INTERNAL GUIDANCE OF THE LEGS OF A STAPLE

(75) Inventors: Olle Strååt, Hestra; Trygve Gustafsson, Åsenhöga, both of (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 09/425,889

(22) Filed: Oct. 25, 1999

Related U.S. Application Data

(63) Continuation of application No. PCT/SE98/00709, filed on Apr. 20, 1998.

(30) Foreign Application Priority Data

Apr. 24, 1997 (SE) ..... 9701536

(51) Int. Cl.[7] ..... B25C 7/00
(52) U.S. Cl. ..... 227/119; 227/107
(58) Field of Search ..... 227/119, 129, 227/123, 82, 83, 88, 89, 90, 107

(56) References Cited

U.S. PATENT DOCUMENTS 2,086,922 * 7/1937 Peterson ..... 227/119
3,009,156 * 11/1961 Lerner ..... 227/88
4,431,127 2/1984 Watanabe ..... 227/76
4,527,725 * 7/1985 Foslien ..... 227/88
4,991,763 * 2/1991 Storace ..... 227/119
5,098,002 * 3/1992 Hansch et al. ..... 227/82
5,452,835 * 9/1995 Shkolnikov ..... 227/119

FOREIGN PATENT DOCUMENTS 137 623 7/1952 (SE) .

* cited by examiner

*Primary Examiner*—Scott A. Smith
(74) *Attorney, Agent, or Firm*—Miles & Stockbridge P.C.

(57) ABSTRACT

A stapler for driving staples (12) into a sheaf of papers comprises two guide elements (17, 17', 17"; 18, 18', 18") for internal guidance of the legs (12*a*) of the staple (12) during the driving of the staple into the object. Each guide element (17, 17', 17"; 18, 18', 18") consists of at least two substantially identical, separate guide parts (17, 17', 17"; 18, 18', 18") successively arranged seen in the driving direction of the staple (12). Each guide part (17, 17', 17"; 18, 18', 18") is movable between a first position, in which it extends into the driving path of the staple (12) to abut against the inside of the respective leg (12*a*) during the driving of the staple, and a second position, in which it is removed against spring action from the driving path of the staple (12). Each of the guide parts (17, 17', 17"; 18, 18', 18") has a ramp portion (23, 23', 23", 24, 24', 24") for such cooperation with the web portion (12*b*) of the staple (12) that it is removed by the web portion against spring action as the driving of the staple (12) proceeds.

6 Claims, 4 Drawing Sheets

STAPLER WITH INTERNAL GUIDANCE OF THE LEGS OF A STAPLE

This application is a continuation of International Application No. PCT/SE98/00709 filed on Apr. 20, 1998, which is incorporated herein by reference.

BACKGROUND OF THE INVENTION

The present invention relates to a stapler for driving staples into an object, such as a sheaf of papers, said stapler comprising a drive element arranged to expel a substantially U-shaped staple and drive its legs through said object.

When stapling a relatively thick sheaf of papers, a guide means is usually used for external guidance of the staple legs during the driving of the staple into the sheaf of papers. This guide means prevents the legs from bending outwards during the driving.

When stapling a thicker sheaf of papers or when stapling a sheaf of papers consisting of a comparatively small number of sheets of paper of a harder quality, e.g. sheets of paper of the type used for colour photocopies, the staple is slightly deformed in spite of the use of a guide means for external guidance of the staple legs.

When the drive element performs a driving stroke, i.e. is moved from an upper position to a lower position, its lower edge surface abuts against the web portion of the staple to press the staple legs through the sheaf of papers. When the driving resistance is too great, e.g. when the sheaf of papers is thick or when it consists of hard sheets of paper, the staple is deformed. This deformation consists in the upper portion of the staple legs sliding or creeping in under the drive element. During the continued driving stroke of the drive element, the staple then crumples up on the upper side of the sheaf of papers.

In an attempt to solve this deformation problem when stapling sheets of paper in a sheaf offering a considerable driving resistance to the staple legs, an underlying support for the web portion of the staple is used in a prior-art stapler. This support is connected with the drive element and follows it in its reciprocating movement. The support is pivotable about an axis, which is substantially parallel to the web portion of the staple, to be inserted under the web portion to form a support thereof, when the drive element abuts against the web portion of the staple during its driving stroke, and to be removed from its position under the web portion at the end of the driving stroke, before the web portion reaches the upper side of the sheaf of papers.

This solution functions fairly well and prevents a deformation of the staple of the kind described above, but it is complicated and takes up a relatively great deal of space.

In a known stapler, the deformation problem described above is solved in a considerably easier way by the drive element being provided with two protruding projections at the same mutual distance as the legs of the staple, which projections are arranged to engage the web portion of the staple just opposite a staple leg each, the projections being pointed in order to bite a distance into the web portion of the staple in the engagement therewith. By this design of the drive element, it is possible to drive the staples without deformation into sheaves of papers, which are considerably thicker than the sheaves of papers being stapable by means of prior-art staplers, which lack an underlying support for the web portion of the staple.

SUMMARY OF THE INVENTION

This stapler can be further improved to allow stapling of sheaves of papers offering a greater driving resistance to the staple legs. This can be achieved by providing the stapler with a prior-art guide means for internal guidance of the legs of the staple during the driving of the staple into the sheaf of papers. Such a guide means is movable between a first position, in which it extends into the driving path of the staple to abut against the inside of the legs during the driving of the staple, and a second position, in which it is removed against spring action from the driving path of the staple. The guide means has a ramp means for such cooperation with the web portion of the staple that the guide means is removed against spring action to its second position by the web portion as the driving of the staple proceeds. The guide means has two guide elements, which are arranged to abut against the inside of a leg each during the driving of the staple, thereby preventing the legs from bending inwards during the driving.

Two such guide elements will now be described with reference to FIGS. 1 and 2. FIG. 1 shows a guide element having a ramp surface with a steep inclination, and FIG. 2 shows a guide element having a ramp surface with a less steep inclination.

FIGS. 1 and 2 show a stapler very schematically, the drive element 1 of the stapler being shown in its driving stroke, i.e. during the driving of a U-shaped staple 2 into a sheaf of papers (not shown). The lower edge surface of the drive element 1 then abuts against the web portion 2*b* of the staple 2. FIGS. 1 and 2 also show one guide element 3 of a guide means intended for internal guidance of the two legs 2*a* of the staple 2 during the driving of the staple 2. The guide element 3 is movable between a first position, in which it is inserted into the driving path of the staple 2 to abut against the inside of the corresponding staple leg 2*a,* and a second position, in which it is removed against spring action from the driving path of the staple 2. The guide element 3 has a ramp surface 4 facing upwards. During the driving of the staple 2, its web portion 2*b* abuts against the ramp surface 4 and then presses the guide element 3 from its first position to its second position (to the left in FIGS. 1 and 2) as the driving of the staple 2 proceeds.

The ramp surface 4 of the guide element 3 shown in FIG. 1 has an inclination different from that of the ramp surface 4 of the guide element 3 shown in FIG. 2. The steep inclination, shown in FIG. 1, gives the advantage of the extension of the guide element 3 in the moving direction of the guide element being fairly small, which results in the guide element 3 requiring a comparatively small space. The steep inclination gives, however, the disadvantage that a great deal of the upper portion of the staple leg 2*a,* as is clearly shown in FIG. 1, does not obtain an internal support from the guide element 3. When the sheaf of papers is thick and exhibits a great resistance to the driving in of staples, it is important that the leg 2*a* be guided over as much as possible of its length. This is the reason why a guide element 3 of the type shown in FIG. 2 must be used, i.e. a guide element whose ramp surface 4 has a less steep inclination. Such a guide element 3 offers, as is shown in FIG. 2, an internal support to the staple leg 2*a* substantially over its entire length. The disadvantage of the less steep inclination is that the guide element 3 is given a large extent in the moving direction and thus takes up a great deal of space, especially as a space must be available for the movement of the guide element between its two positions.

The object of the present invention is to provide a stapler, which is fitted with a guide means intended for internal guidance of the staple legs during the driving of the staple into an object, the guide means being of the type described above and its two guide elements offering an adequate support for the staple legs substantially over their entire length, while taking up a comparatively small space.

According to the present invention, this object is achieved by a stapler for driving staples into an object, such as a sheaf of papers, which stapler comprises a drive element arranged to expel a substantially U-shaped staple and drive its legs through said object, and a guide means for internal guidance of the legs of the staple during the driving of the staple into the object, which guide means is movable between a first position, in which it extends into the driving path of the staple to abut against the inside of the legs during the driving of the staple, and a second position, in which it is removed against spring action from the driving path of the staple, and which guide means has a ramp means for such cooperation with the web portion of the staple that the guide means is removed by the web portion against spring action to its second position as the driving of the staple proceeds, the guide means having two guide elements arranged to abut against the inside of a leg each during the driving of the staple, and which stapler is characterised in that each guide element consists of at least two substantially identical, separate guide parts successively arranged seen in the driving direction of the staple, each guide part having a ramp portion for such cooperation with the web portion of the staple that it is removed by the web portion against spring action as the driving of the staple proceeds.

Conveniently, each guide element consists of three separate parts.

In a preferred embodiment, the parts of one guide element are each connected to one of the parts of the other guide element, each pair of interconnected parts forming the legs of a substantially U-shaped bracket. The brackets are advantageously formed at one end of a leaf spring each.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 11:
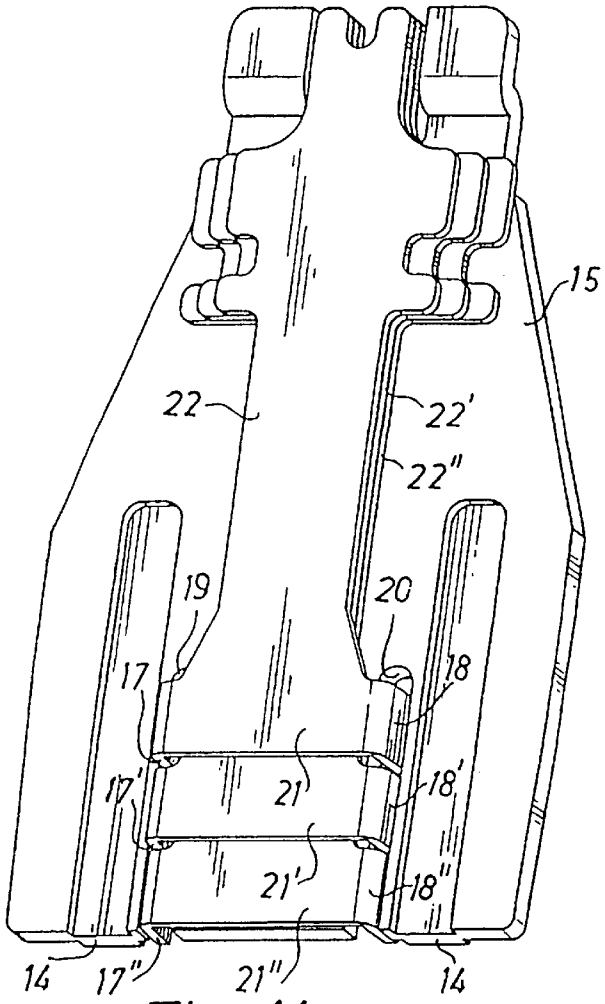
FIG. 11 is a perspective view showing the guide element of the stapler from the opposite side in relation to FIGS. 3–6.
Figure 2:
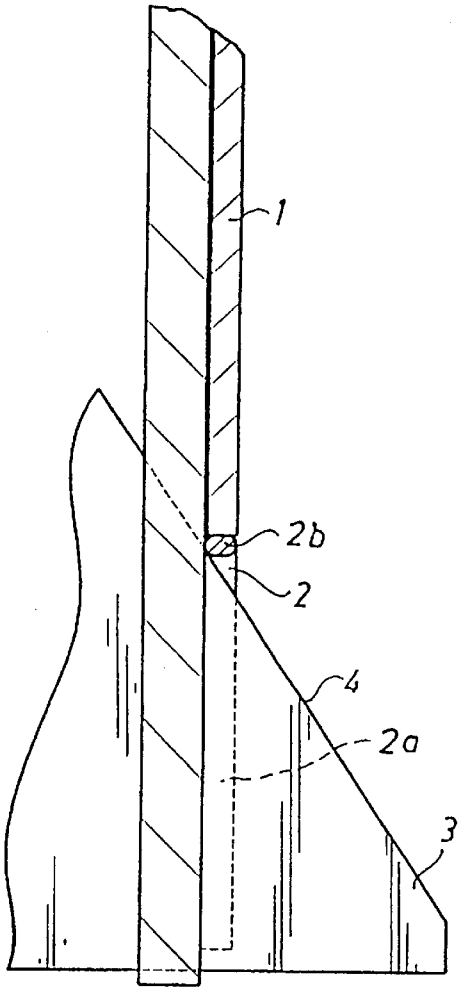
FIGS. 1 and 2 show the guide elements described above for internal guidance of a staple leg.
Figure 1:
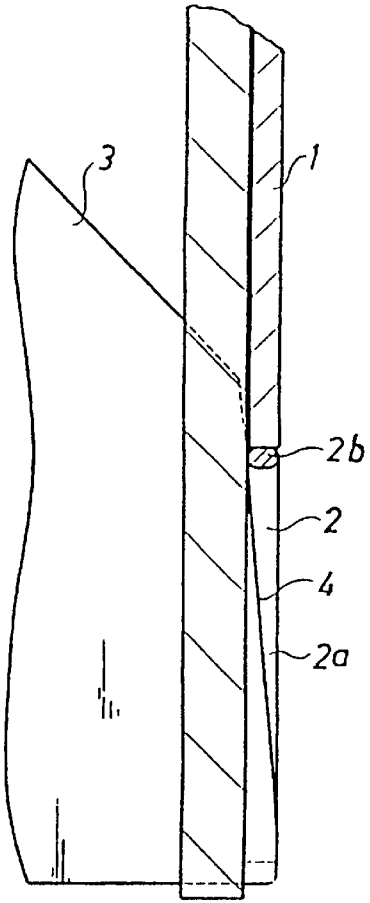
Figure 4:
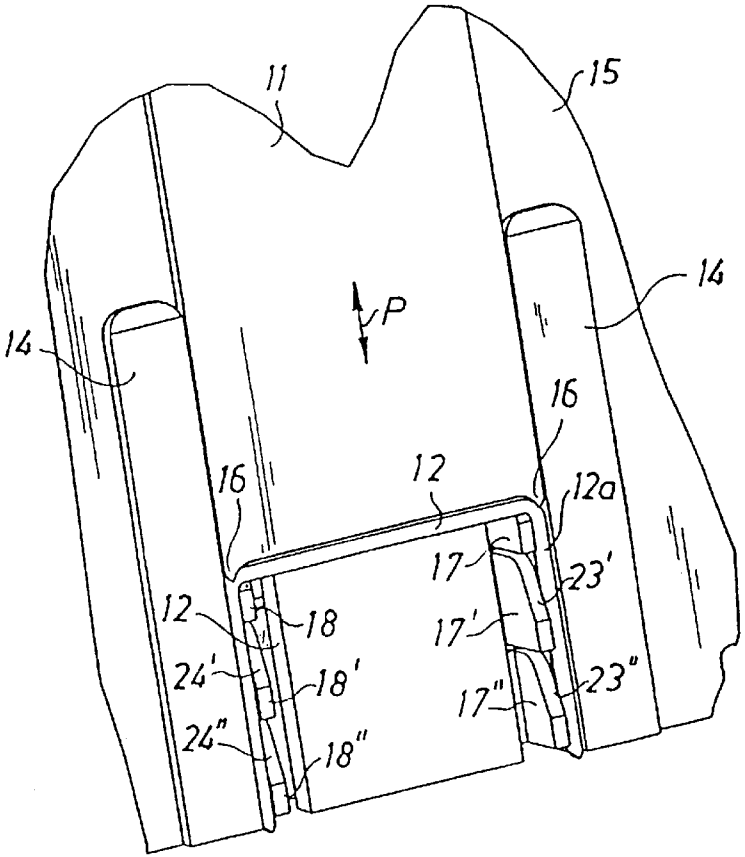
FIGS. 3–6 are perspective views schematically showing a stapler according to the invention in different driving positions.

The stapler according to the invention illustrated in FIGS. 3–6, of which only a fraction is shown, has a drive element 11 for driving a substantially U-shaped staple 12 into a sheaf of papers 13 (cf. FIGS. 7–10). Two guide strips 14 for external guidance of the legs 12*a* of the staple 12 during the driving of the staple into the sheaf of papers 13 are formed on a front plate 15.

The staple 12 is formed by bending a wire-shaped staple blank. This blank is contained in a magazine (not shown) together with a plurality of other staple blanks, from which magazine it is advanced to a staple forming position, in which the blank is formed to a substantially U-shaped staple 12. The staple 12 thus formed is then advanced to its driving position just under the drive element 11, i.e. slightly in front of (as related to FIGS. 3–6) the front plate 15.

The drive element 11 consists of a substantially rectangular metal sheet piece and is reciprocatingly arranged in the stapler in the direction of the double arrow P. The drive element 11 is reciprocatable between an upper initial position and a lower end position. In FIGS. 3–6, the drive element 11 is shown in its driving stroke, i.e. in its movement from the initial position to the lower end position, its lower edge surface abutting against the back or web portion 12*b* of the staple 12. In its driving stroke, the drive element 11 drives the legs 12*a* of the staple 12 into the sheaf of papers 13 and through the same with no deformation of the staple 12, not even when the sheaf of papers is relatively thick or consists of rather hard sheets of paper.

The drive element 11 has two projections 16 protruding from the lower edge surface of the drive element. The projections 16 are located at the same mutual distance as the legs 12*a* of the staple 12 and are arranged to engage the web portion 12*b* of the staple 12 just opposite a leg 12*a* each of the staple 12. The projections 16 are pointed in order to bite a distance into the web portion 12*b* of the staple 12 in the engagement therewith.

The stapler also has two guide elements 17, 17', 17" and 18, 18', 18" for internal guidance of the legs 12*a* of the staple 12 during the driving of the staple into the sheaf of papers 13. The two guide elements 17, 17', 17" and 18, 18', 18" extend from the back (as related to FIGS. 3–6) through a slot 19, 20 each in the front plate 15 and protrude a distance in front thereof (as related to FIGS. 3–6). The two guide elements 17, 17', 17" and 18, 18', 18" each abut against a staple leg 12*a* during the driving of the staple 12.

Each of the two guide elements consists of three substantially identical, separate guide parts 17, 17', 17" and 18, 18', 18", respectively, successively arranged seen in the driving direction of the staple 12. Thus, the guide parts 17, 17' and 17" as well as the guide parts 18, 18' and 18" are arranged just above one another. The guide parts 17, 17' and 17" in one of the guide elements are arranged in horizontal alignment with a guide part 18, 18' and 18" each in the second guide element. The guide parts in each of these pairs 17, 18, 17', 18' and 17", 18" of such guide parts arranged in horizontal alignment are connected to each other so as to form the legs of a substantially U-shaped bracket 21, 21' and 21", respectively (cf. FIG. 11). These brackets 21, 21' and 21" are formed at one end of a leaf spring 22, 22' and 22" each. The leaf springs 22, 22' and 22", which have different length, are clamped behind the front plate 15 in a manner not shown in detail, such that the guide parts 17, 18, 17', 18', 17", 18" normally are located in the position shown in FIGS. 3 and 7, in which they extend into the driving path of the staple 12 to abut against the respective staple legs 12*a*. The guide parts 17, 18, 17', 18', 17", 18" can be pressed in pairs against the spring action of the respective leaf springs 22, 22', 22" to a second position, in which they are fully removed from the driving path of the staple 12.

Each of the guide parts 17, 17', 17", 18, 18' and 18" has an upper horizontal edge surface, a lower vertical edge surface and an intermediate ramp surface 23, 23', 23", 24, 24' and 24", respectively, for cooperation with the web portion 12*b* of the staple 12.

Figure 3:
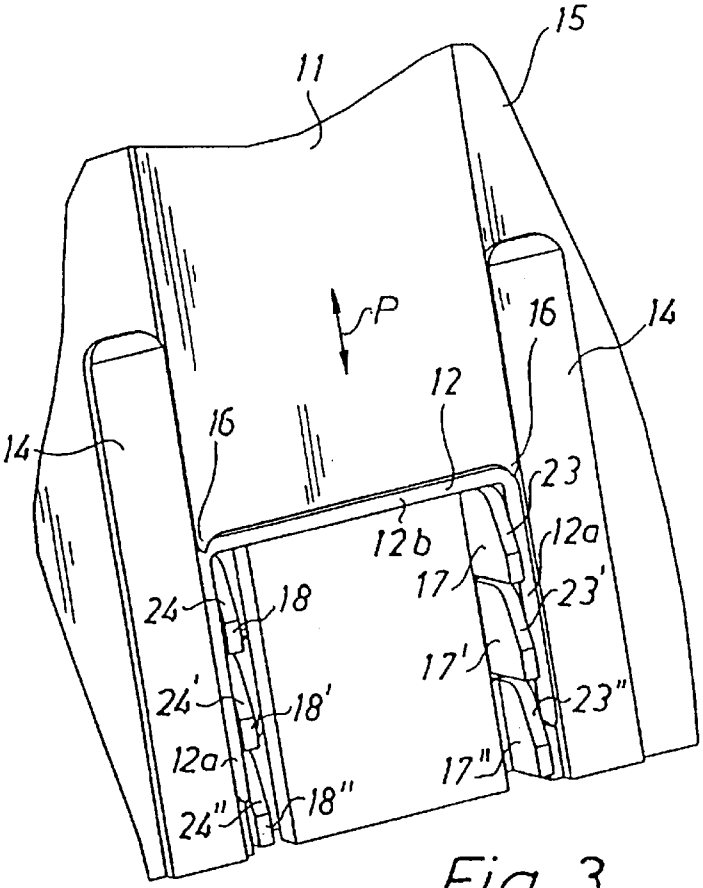
Figure 6:
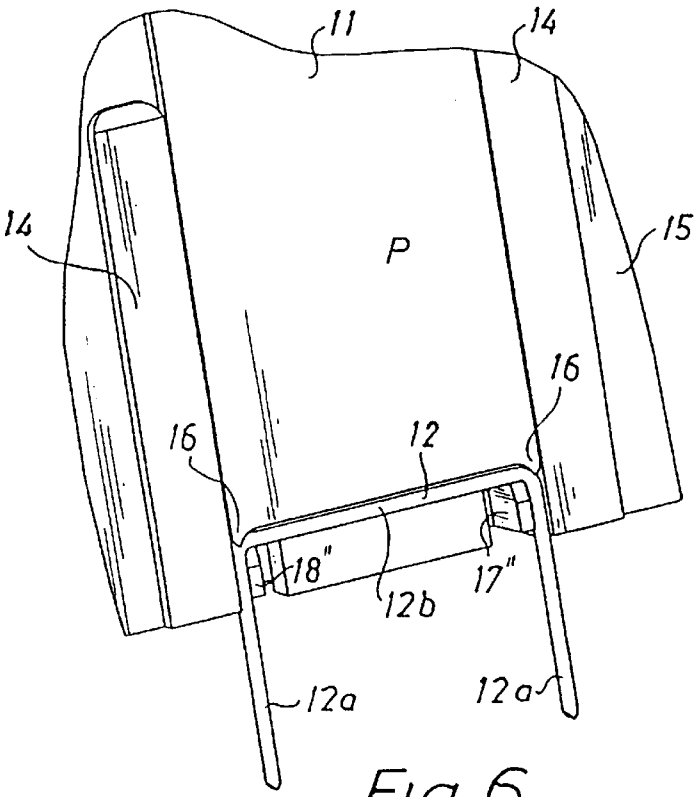
Figure 5:
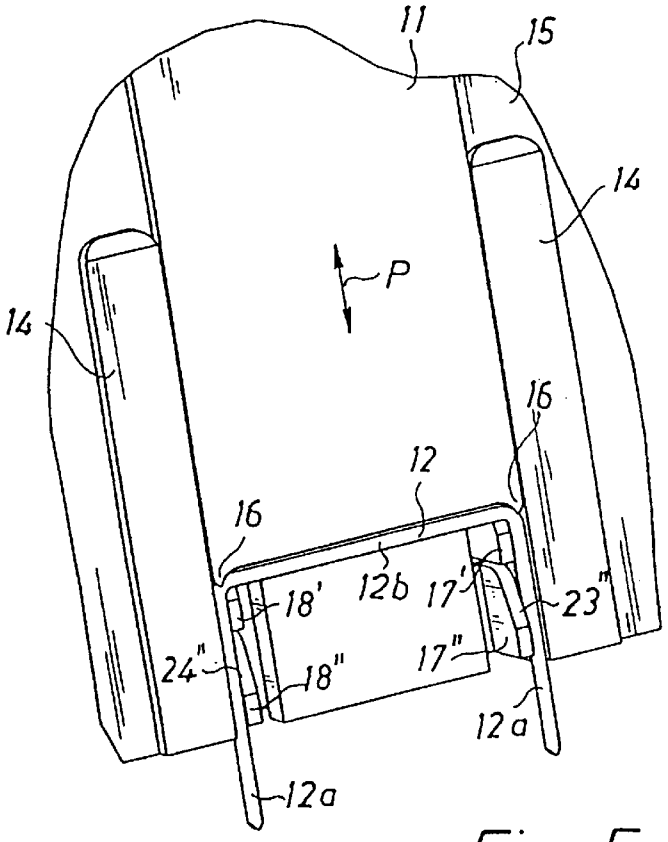
Figure 7:
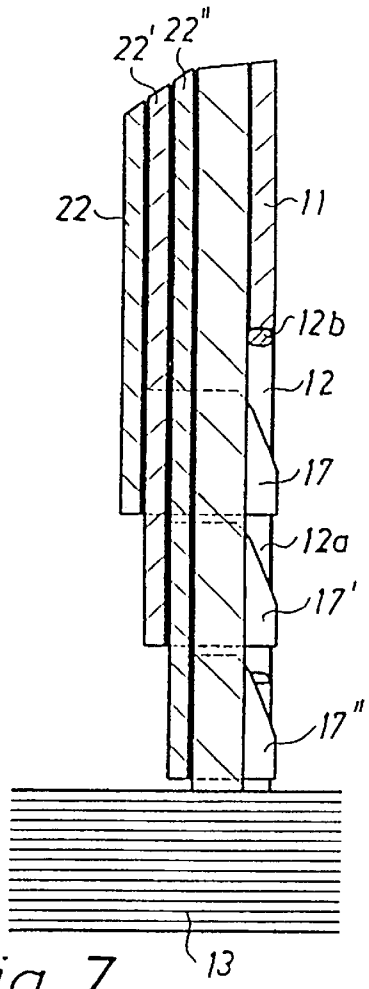

In FIGS. 3 and 7, the stapler is shown in a driving position, in which the drive element 11 in its driving stroke has just engaged the web portion 12*b* of the staple 12 to expel the staple 12 and drive it into the sheaf of papers 13. In the driving position shown in FIGS. 3 and 7, the web portion 12*b* is positioned a distance above the upper pair of guide parts 17, 18 and the point of the staple legs 12*a* has not yet reached the sheaf of papers 13.

When the web portion 12*b* of the staple 12 has reached the ramp surface 23 and 24, respectively, of the upper guide parts 17 and 18, it presses these parts 17 and 18 backwards against the action of the leaf spring 22 during the continuing driving stroke of the drive element 11. In the driving position shown in FIGS. 4 and 8, the web portion 12*b* has pressed the upper pair of guide parts 17, 18 from the normal position to a partially moved-away position and the point of the staple legs 12*a* has just reached the upper side of the sheaf of papers 13.

Figure 9:
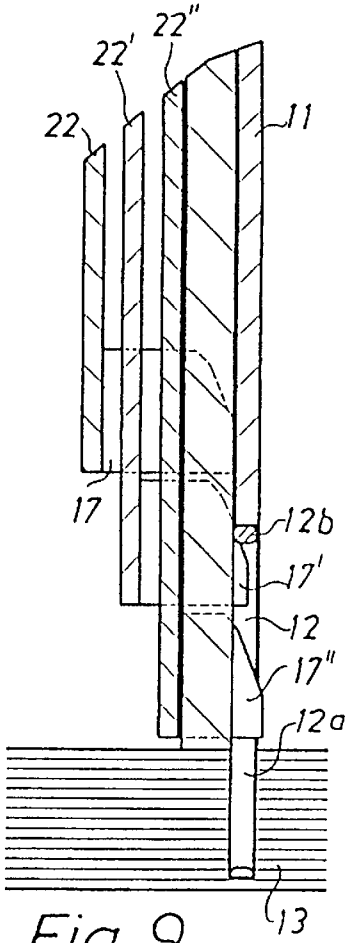
Figure 8:
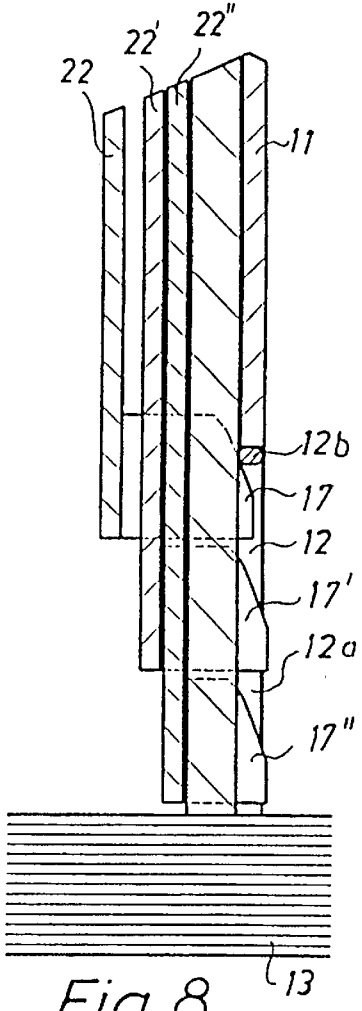

As the web portion 12*b* of the staple 12 has pressed the upper guide parts 17 and 18 to a fully moved-away position, in which, as shown in FIG. 9, they are retained by the drive element 11, the web portion 12*b* hits the ramp surfaces 23' and 24', respectively, of the intermediate guide parts 17' and 18' and presses the intermediate guide parts 17', 18' backwards against the action of the leaf spring 22' during the continuing driving stroke of the drive element 11. In the driving position shown in FIGS. 5 and 9, the upper pair of guide parts 17, 18 is in a fully moved-away position, the intermediate pair of guide parts 17', 18' is in a partially moved-away position and the staple legs 12*a* have been driven a considerable distance into the sheaf of papers 13.

Figure 10:
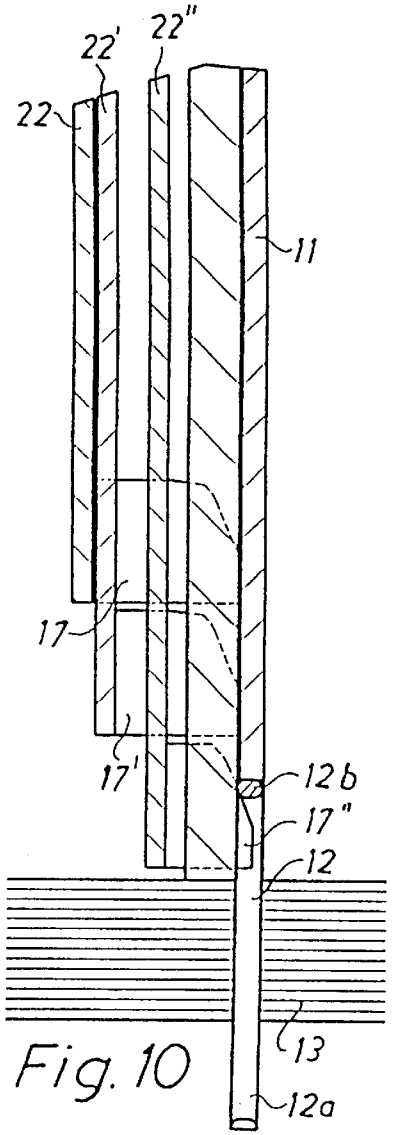
FIGS. 7, 8, 9 and 10 are vertical section views showing a drive element, a guide element and a staple in different driving positions corresponding to the position shown in FIGS. 3, 4, 5 and 6, respectively.

When the web portion 12*b* of the staple 12 has pressed the intermediate guide parts 17' and 18' to a fully moved-away position, in which, as shown in FIG. 10, they are retained by the drive element 11, the web portion 12*b* hits the ramp surfaces 23" and 24", respectively, of the lower guide parts 17" and 18" and presses the lower guide parts 17" and 18" backwards against the action of the leaf spring 22" during the continuing driving stroke of the drive element 11. In the driving position shown in FIGS. 6 and 10, the upper and the intermediate pairs of guide parts 17, 18 and 17', 18', respectively, are in a fully moved-away position, the lower pair of guide parts 17", 18" is in a partially moved-away position and the point of the staple legs 12*a* has been driven through the sheaf of papers 13, the web portion 12*b* having, however, not yet reached the upper side of the sheaf of papers 13. When this happens, the driving stroke of the drive element 11 is completed and the lower pair of guide parts 17", 18" is also in a fully moved-away position.

By dividing each of the two drive elements for internal guidance of the staple legs in the manner described above and shown in the drawings, it is easily understood that a proper internal support of the staple legs is achieved substantially over their entire length, while at the same time the guide elements totally seen are given a relatively small extent in their moving direction.

It will be appreciated that the invention can be modified in many ways within the scope of the appended claims. For instance, the number of guide parts in each guide element can be selected as desired.

Finally, it should be noted that "upper", "lower", "horizontal" and "vertical" relate to the most common working position of the stapler and are only used herein to facilitate the description of the disclosed embodiment. The stapler can, of course, be used in positions other than the one described and shown in the drawings.

What is claimed is:

1. A stapler for driving staples (12) into an object (13), such as a sheaf of papers, said stapler comprising a drive element (11) arranged to expel a substantially U-shaped staple (12) and drive its legs (12*a*) through said object, and a guide means (17, 17', 17",18, 18', 18") for internal guidance of the legs (12*a*) of the staple (12) during the driving of the staple into the object, which guide means is movable between a first position, in which it extends into the driving path of the staple to abut against the inside of the legs during the driving of the staple, and a second position, in which it is removed against spring action from the driving path of the staple, and which guide means has a ramp means (23, 23', 23", 24, 24', 24") for such cooperation with the web portion (12*b* ) of the staple (12) that the guide means is removed by the web portion against spring action to its second position as the driving of the staple proceeds, the guide means having two guide elements (17, 17', 17"; 18, 18', 18") arranged to abut against the inside of a leg (12*a*) each during the driving of the staple (12), characterised in that each guide element (17, 17', 17"; 18, 18', 18") consists of at least two substantially identical, separate guide parts (17, 17', 17",18, 18', 18") successively arranged seen in the driving direction of the staple (12), each guide part having a ramp portion (23, 23', 23", 24, 24', 24") for such cooperation with the web portion (12*b*) of the staple (12) that it is removed by the web portion against spring action as the driving of the staple proceeds.

2. A stapler according to claim 1, characterised in that each guide element consists of three separate parts (17, 17', 17"; 18, 18', 18").

3. A stapler according to claim 2, characterized in that the parts (17, 17', 17") of one guide element are each connected to one of the parts (18, 18', 18") of the other guide element, each pair (17, 18; 17', 18'; 17", 18") of interconnected parts forming the legs of a substantially U-shaped bracket (21, 21', 21").

4. A stapler according to claim 3, characterized in that the brackets (21, 21', 21") are formed at one end of a leaf spring (22, 22', 22") each.

5. A stapler according to claim 1, characterised in that the parts (17, 17', 17") of one guide element are each connected to one of the parts (18, 18', 18") of the other guide element, each pair (17, 18; 17', 18'; 17", 18") of interconnected parts forming the legs of a substantially U-shaped bracket (21, 21', 21").

6. A stapler according to claim 3, characterised in that the brackets (21, 21', 21") are formed at one end of a leaf spring (22, 22', 22") each.

* * * * *